United States Patent [19]

Wilson et al.

[11] 4,082,125

[45] Apr. 4, 1978

[54] SPILLAGE COLLECTION DEVICE FOR FUEL TANKS FOR BOATS

[76] Inventors: Layton G. Wilson, 226 Yarmouth La., Media, Pa. 19063; William Ward, IV, 8 Kershaw Rd., Wallingford, Pa. 19086

[21] Appl. No.: 715,929

[22] Filed: Aug. 19, 1976

[51] Int. Cl.[2] ..... B65B 3/04

[52] U.S. Cl. ..... 141/86; 141/377; 312/229

[58] Field of Search ..... 141/86, 87, 88, 115, 141/390, 311, 346, 369–392; 312/229, 236; 248/489, 490

[56] References Cited

U.S. PATENT DOCUMENTS 2,520,380 8/1950 Wegman ..... 141/86

3,861,639 1/1975 Morrill ..... 248/489

*Primary Examiner*—Houston S. Bell

*Attorney, Agent, or Firm*—Frailey & Ratner

[57] ABSTRACT

A device for preventing water pollution is provided, to collect and retain liquid fuel overflow from fuel tanks for boats and similar vessels. The device is designed to collect fuel discharged from the air vent of an enclosed fuel storage tank, when the tank is refilled. A support ring is affixed to the external surface of the hull of the boat, telescopically relative to the air vent protruding threfrom. A hollow receptacle is adapted to be mounted on the support ring, for collecting fuel discharged from the vent. A retainer sustains the receptacle on the support, and locking means detachably secures the retainer to the support, while the receptacle is collecting fuel discharged or spilled from the air vent.

9 Claims, 5 Drawing Figures

SPILLAGE COLLECTION DEVICE FOR FUEL TANKS FOR BOATS

BACKGROUND OF THE INVENTION

The present invention comprises an anti-pollution device which prevents the inadvertent discharge of liquid fuel from a boat into the adjacent body of water. The device is designed to collect fuel spilled or discharged from the air vent of an enclosed fuel storage tank, during refilling thereof. The device includes a fuel collecting receptacle, a support for the receptacle and means for mounting and detachably securing the receptacle to the support.

As far as is presently known, no such anti-pollution means is available for small, private vessels used primarily for pleasure and recreation. The present invention makes available such anti-pollution means, which not only prevents the accidental spillage of liquid fuel from a fuel tank air vent into the water, but also permits the collection and recycling of the inadvertently discharged fuel.

SUMMARY OF THE INVENTION

The primary object of this invention is to provide an anti-pollution device for preventing the accidental discharge of liquid fuel from the air vent of an enclosed fuel storage tank of a boat into the surrounding water.

A further object of the invention is to provide a spillage collection device for a fuel tank for a boat, which is removably mounted relative to a fuel tank air vent, and adapted to collect for recycling liquid fuel spilling from the air vent.

A further object is to provide a fuel overflow collection device for a fuel tank for a boat, which is adapted to be detachably secured relative to a fuel tank air vent, for collecting liquid fuel spilling therefrom and which includes a support and locking means for detachably retaining the receptacle on the support.

To achieve the foregoing objectives, the invention in its preferred form, includes a hollow receptacle for collecting liquid fuel overflowing from a fuel tank air vent, a support for the receptacle affixed to the exterior of the hull of the boat, a retainer to the receptacle for mounting the receptacle on the support and locking means associated with the retainer for detachably securing the receptacle to the support.

DETAILED DESCRIPTION OF THE INVENTION

Figure 1:
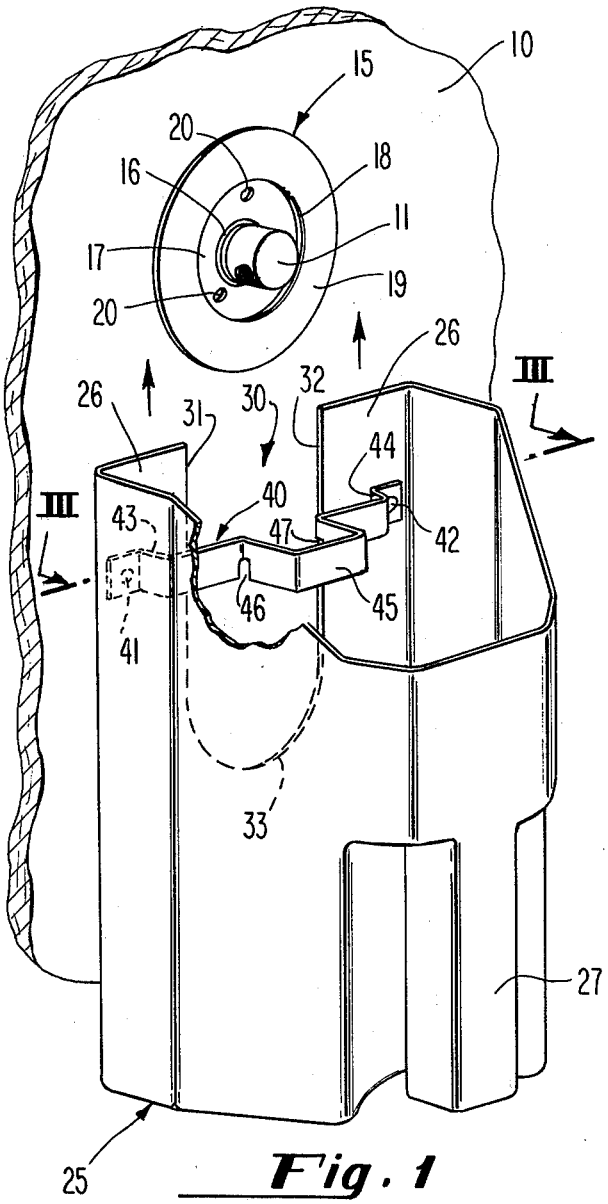
FIG. 1 is a fragmentary, elevational view in perspective, showing a preferred embodiment of this invention, with the fuel overflow catch receptacle separated from its support means.

The term "fuel" used herein shall indicate any form of liquid fuel, such as deisel oil, gasoline and the like, stored in enclosed fuel storage tanks on board a boat or similar vessel, and used as the fuel for one or more internal combustion engines for powering such boat or vessel.

Referring to the drawing, the reference numeral 10 indicates a portion of the hull of a boat (not shown) having one or more enclosed fuel tanks (also not shown). Each of the fuel tanks is provided with a conventional air vent 11 extending externally of the hull 10. The air vent 11 extends through the hull 10 (FIG. 5), and is secured thereto in any conventional manner. Its inboard portion is connected by a suitable conduit 12 to a fuel tank. Air vent 11 and its conduit 12 permit the discharge of air from an enclosed fuel tank when the tank is filled with fuel. Frequency during filling, because of inadvertent over-filling of the tank or for some other reason, fuel passes through the conduit 12 and air vent 11, and spills into the water, causing pollution. The present invention provides a device for collecting such fuel spillage, permitting recycling of the discharged fuel while preventing the occurrence of water pollution.

Figure 5:
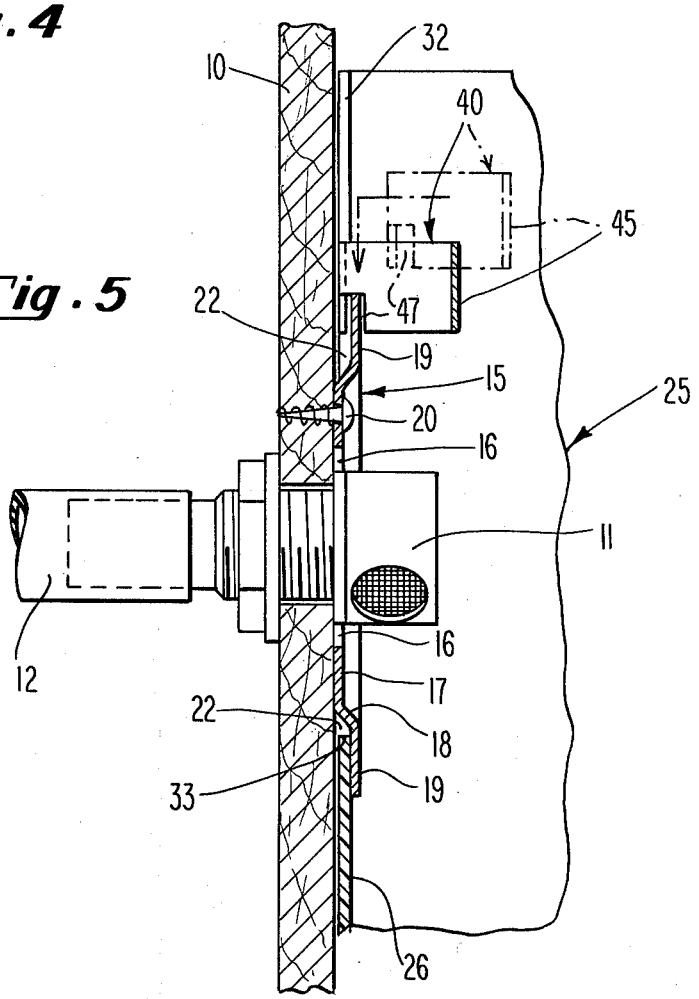
FIG. 5 is an enlarged fragmentary view in vertical section indicated by the arrows V—V of FIG. 2.

The fuel spillage collection device of this invention includes a support ring 15 (FIG. 1) mounted on the exterior surface of the hull 10, and provided with a central aperture 16 disposed telescopically about the air vent 11. The support ring 15 is composed of an inner annular portion 17 and an outer annular portion or flange 19, the two annular portions being integrally joined by means of an annular beveled portion 18 (FIG. 5). The ring 15 is affixed to the hull 10 by a plurality of fastening means, such as screws 20, disposed at spaced angular intervals about the inner annular portion 17 of the ring. By reason of the annular bevel 18, the flange 19 is spaced from the exterior surface of the hull 10, to provide an annular clearance 22 between the hull and support ring 15.

Figure 2:
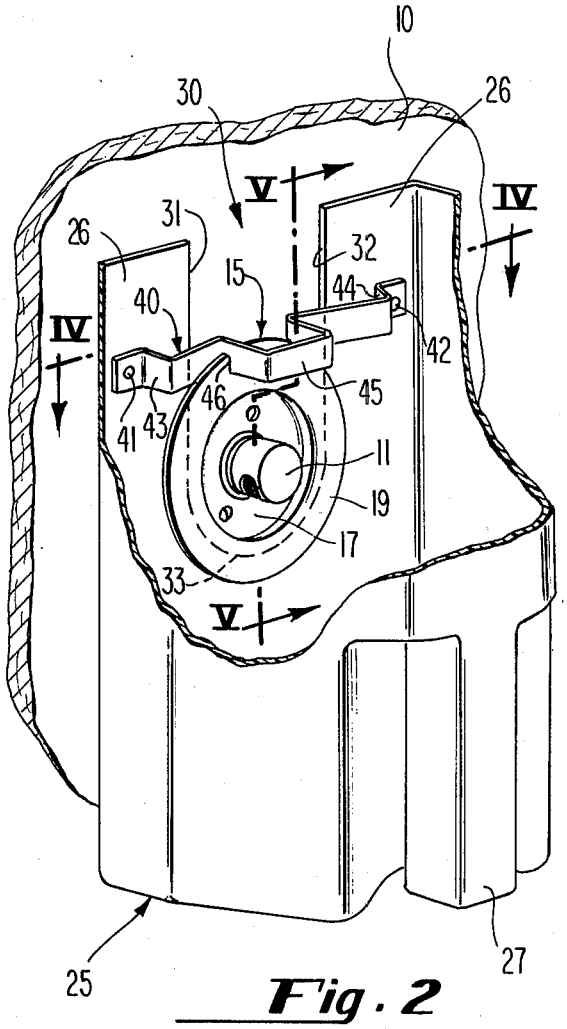
FIG. 2 is a view similar to FIG. 1, illustrating the receptacle mounted on its support means.
Figure 3:
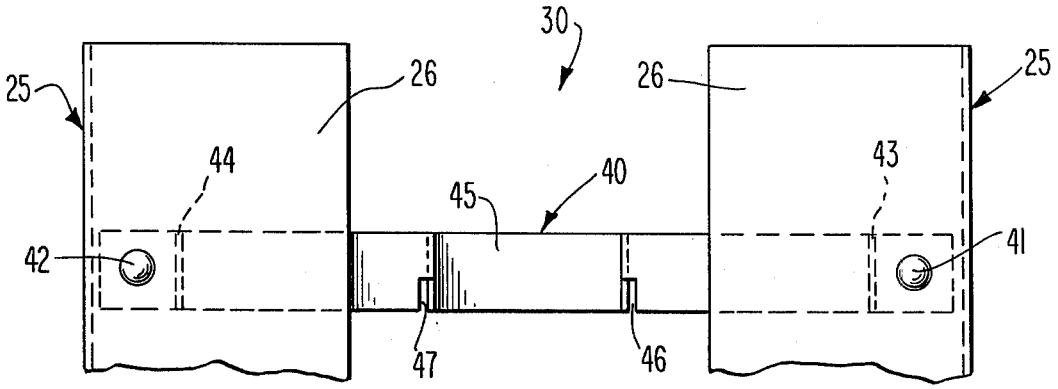
FIG. 3 is an enlarged fragmentary view indicated by the arrows III—III of FIG. 1.

As best illustrated in FIG. 2, the ring 15 is designed to support detachably a hollow receptacle 25 for collecting fuel discharged from the air vent 11. The receptacle 25 may be of any conventional bucket-like construction, with a rear wall 26 adapted to bear or rest against the outer surface of the hull 10, and having a suitable handle 27. Preferably, it is made of tough, but flexible, plastic material. Formed in the upper portion of the rear wall 26 of the receptacle 25 is an elongated, open-ended, vertical slot 30, having opposing interior side edges 31, 32 joined at their lower extremities by an arcuate rear edge 33. The distance or width between the spaced opposing edges 31, 32 is greater than the outer diameter of the inner annular portion 17 of ring 15, but is smaller than the outer diameter of the flange 19. The thickness of the rear wall 26 of the receptacle 25 approximates the width of the annular clearance 22 between the flange 19 and the outer surface of the hull 10.

By reason of the relative dimensions aforesaid, the rear wall 26 of the receptacle 25 is slidably engageable within the annular clearance 22. More specifically, as indicated by the directional arrows in FIG. 1, slot 30 permits the receptacle 25 to be slid vertically upward into frictional engagement with support ring 15, by the inter-engagement of the spaced portions of the rear wall 26 within the annular clearance 22. Preferably, the thickness of the rear wall 26 and the width of the annular clearance 22 are of such close tolerance as to provide for a snug fit of the spaced portions of the wall 26 within the clearance 22. This provides sufficient frictional contact between those parts to maintain the empty receptacle 25 in fuel receiving position relative to the air vent 11, when slot 30 is fully engaged with the ring 15.

To retain the receptacle 25 on the support ring 15, an elongated flexible hanger strap 40 is mounted to the inside of the rear wall 26 of the receptacle. Strap 40 preferably is formed of spring metal having capacity to be deflected transversely relative to its length. It extends across the slot 30, and has its opposite ends affixed by any suitable securing means 41, 42 to the inner surface of the rear wall 26 of the receptacle.

Adjacent each of its ends, the retainer strap 40 is provided with right-angled double bends 43, 44, whereby the central portion of the strap 40 is spaced inwardly from the slot 30, in the direction of the interior of the receptacle 25. Such inward spacing of the central portion of the receptacle retainer 40 provides clearance between the retainer and the exterior of the support ring flange 19, when the receptacle 25 is slid vertically upward into frictional engagement with the support ring 15. The central portion of the retainer strap 40 is provided with an offset 45 to ensure that the retainer 40 clears the outer portions of the air vent 11, during mounting of the receptacle 25 on the support 15.

A pair of spaced locking slots 46, 47 are formed in the retainer strap 40 at the spaced locations where offset 45 merges with the strap 40. Preferably, the slots or openings 46, 47 are of a width which approximates the width of the flange 19, to permit the slots to engage snugly with the rim of the flange, as shown in FIG. 2. The spaced slots or openings 46, 47 in the retainer 40 comprise locking means, whereby the receptacle retainer 40 may be detachably secured to the outer rim of the support ring 15.

Figure 4:
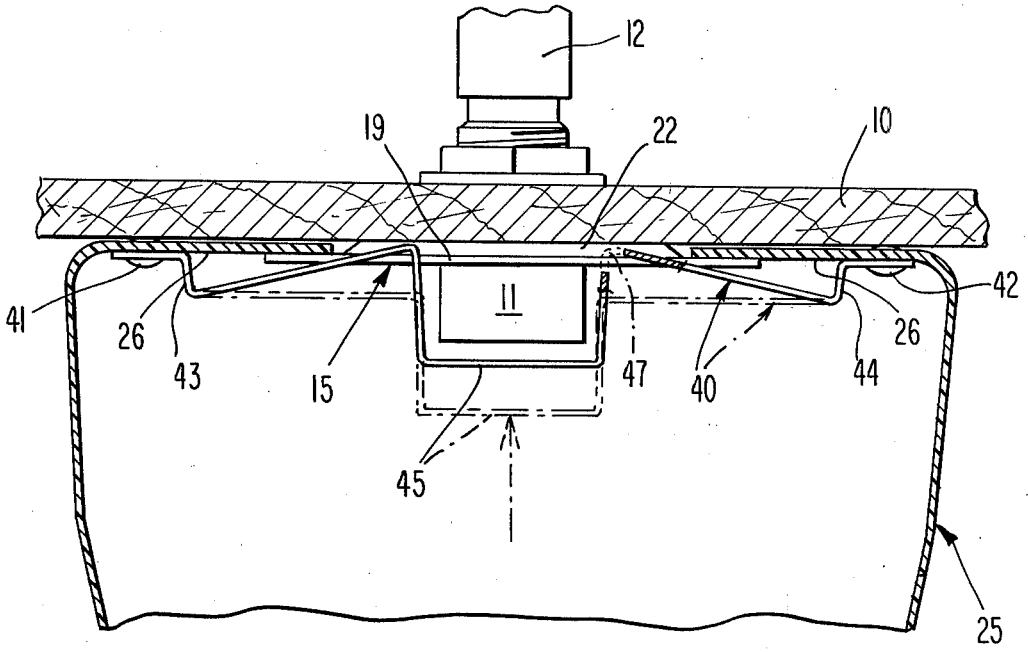
FIG. 4 is an enlarged fragmentary view in horizontal section indicated by the arrows IV—IV of FIG. 2.

By reason of the right-angled bends 43, 44, the spaced locking slots 46, 47 are disposed outwardly of the rim of the flange 19, as illustrated in phantom in FIG. 4 and 5, when the receptacle 25 first is slid upward, into engagement with the support ring 15. The slot 30 is formed of a length which permits the receptacle 25 to be slid upward, relative to ring 15, to position the retainer 40 and its locking slots 46, 47, initially, at a location above the rim of the ring 15 (FIG. 5). Thereupon, the flexible retainer strap 40 is deflected inwardly, in the direction of the support ring 15 (FIG. 4), to position the slots 46, 47 over the ring 15 for engagement with its flange 19. Since the retainer strap 40 is formed of spring metal, it is readily deflectable manually, transversely of its length, to locate the locking slots 46, 47 in position to engage the rim of flange 19 of the ring 15. With the slots thus positioned, the receptacle then is slid downward, relative to the support ring 15 (FIG. 5), to engage the rim of the flange 19 within the slots 46, 47 (FIG. 2). The inherent tendency of the flexible retainer 40 to return to its original, undeflected condition ensures that the slots 46, 47 positively engage the flange 19 to lock the retainer 40 on the support ring 15.

By reason of the construction thus illustrated and described, the receptacle 25 is securely mounted on its support ring 15, thereby ensuring that the receptacle will not be accidentally jarred loose from its support while being utilized to collect fuel overflowing from the air vent 11. The arrangement is such as to permit the ready detachment of the receptacle 25 from its support 15, when use of the device no longer is required. To remove the receptacle 25 from its support 15, the retainer 40 first may be pressed inwardly relative to the flange 19, to reduce the frictional engagement between the slots 46, 47 and the flange. Thereupon, the receptacle is elevated slightly to disengage the locking slots, and the retainer 40 is permitted to snap outwardly to its normal position. The receptacle then is readily removed by being pulled vertically downward away from its support 15. The arrangement and dimensions of the parts, and the materials employed, particularly the use of spring metal for the flexible retainer 40, permit the ready manipulation and use manually of of the device of this invention.

Although a preferred embodiment of this invention has been shown and described herein for the purpose of illustration, as required by Title 35 U.S.C. Sec. 112, it is to be understood that various changes and modifications may be made therein without departing from the spirit and utility of the invention, or the scope thereof as set forth in appended claims.

We claim:

1. A spillage collection device for a fuel tank for a boat, said fuel tank being disposed inboard of the boat hull and having an air vent extending through and externally of the hull, said device comprising:

(a) a hollow receptacle for collecting spilled fuel,
(b) a support for the receptacle affixed to the exterior surface of the hull of the boat,
(c) said support being disposed adjacent the exteriorly extending portion of the air vent,
(d) a retainer affixed to the receptacle for mounting the receptacle on the support to collect fuel spilled from the air vent and
(e) locking means for detachably securing the retainer to the support.

2. The device of claim 1, wherein:

(a) the receptacle support is a ring having an opening for engaging telescopically the externally extending portion of the air vent,
(b) said ring having an inner annular portion disposed contiguous with the exterior surface of the hull and an annular flange spaced from the exterior surface of the hull,
(c) the receptacle is provided with an open ended slot having opposing interior edges,
(d) said slot having a distance between its opposing interior edges greater than the outer diameter of the inner annular portion of the support ring and smaller than the outer diameter of the flange of the support ring, and
(e) the space between the support ring flange and the exterior surface of the hull provides an annular clearance for slidably engaging the receptacle slot with the support ring, when the retainer is mounted on the support.

3. The device of claim 2, further including fastening means located at spaced intervals about the inner annular portion of the support ring, for affixing the support to the hull.

4. A spillage collection device for a fuel tank for a boat, said fuel tank being disposed inboard of the boat hull and having an air vent extending through and externally of the hull, said device comprising:

(a) a hollow receptacle for collecting spilled fuel, said receptacle having a slot defined by opposing interior edges,
(b) a support for the receptacle, said support having an opening for engaging telescopically the externally extending portion of the air vent, said support having an inner portion disposed contiguous with the exterior surface of the hull and an outer portion spaced from the exterior surface of the hull,
(c) a space between the exterior surface of the hull and the outer portion of the support, said space providing clearance for slidably engaging the receptacle slot with the support, (d) a retainer for mounting the receptacle on the support to position the receptacle to collect fuel spilled from the air vent, said retainer comprising an elongated flexible strap extending across the slot formed in the receptacle, and having opposite ends affixed to the interior of the receptacle, and (e) locking means for detachably securing the retainer to the support, said locking means comprising spaced openings in the retainer for detachable engagement with the outer portion of the support.

5. The device of claim 4, wherein:

(a) the retainer is formed of spring metal having capacity to deflect transversely, relative to the slot formed in the receptacle, (b) the retainer is spaced inwardly from the receptacle slot, in the direction of the interior of the receptacle, to provide clearance between the retainer and the support, when the receptacle slot is engaged initially with the support, (c) the spaced openings in the retainer are slots and (d) the retainer is deflectable in the direction of the support, to permit the detachable engagement of its slots with the outer portion of the support.

6. The device of claim 5, wherein the retainer has an offset portion to provide clearance between the retainer and the air vent during the mounting of the receptacle on the support.

7. The device of claim 4, wherein the receptacle is provided with a handle.

8. A fuel overflow collection device for a fuel tank for a boat, said fuel tank being disposed inboard of the boat hull and having an air vent extending through the hull with a portion of the vent disposed externally thereof, said device comprising:

(a) a hollow receptacle for collecting fuel discharged from the air vent, said receptacle having a rear wall adapted to rest against the hull, (b) a support ring for the receptacle affixed to the exterior of the hull, said ring being disposed telescopically relative to the externally extending portion of the air vent, (c) a flange on the support ring, said flange being spaced from the hull to provide an annular clearance between the ring and the hull, (d) a slot formed in the rear wall of the receptacle, said slot providing means permitting the rear wall of the receptacle to be inserted slidably within the annular clearance between the support ring and the hull, (e) a flexible retainer affixed to the rear wall of the receptacle for suspending the receptacle on the support and (f) locking means disposed on the retainer for detachably securing the retainer to the support ring flange.

9. The device of claim 8, wherein the receptacle retainer is:

(a) disposed internally of the receptacle and extends across the slot formed in the rear wall of the receptacle, (b) spaced inwardly from the slot in the direction of the interior of the receptacle, to provide clearance between the retainer and the exterior of the support ring flange, when the rear wall of the receptacle is inserted slidably within the annular clearance between the support ring and the hull, (c) provided with spaced locking slots and (d) deflectable in the direction of the support ring, to permit the detachable engagement of its locking slots with the rim of the flange.

* * * * *

UNITED STATES PATENT AND TRADEMARK OFFICE

CERTIFICATE OF CORRECTION

PATENT NO. : 4,082,125

DATED : April 4, 1978

INVENTOR(S) : Layton G. Wilson and William Ward, IV

It is certified that error appears in the above-identified patent and that said Letters Patent are hereby corrected as shown below:

Page 1, Abstract, line 8, change "threfrom" to --therefrom--

Column 1, line 44, after "retainer" insert --attached--

Column 2, line 14, change "Frequency" to --Frequently--

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*